US009163204B2

(12) United States Patent
Nishina et al.

(10) Patent No.: US 9,163,204 B2
(45) **Date of Patent: *Oct. 20, 2015**

(54) FRAMED SOAP AND PROCESS FOR PRODUCING SAME

(75) Inventors: Tetsuo Nishina, Takatsuki (JP); Takahito Makita, Ibaraki (JP); Takahiro Okuda, Machida (JP); Tomoko Toda, Sakai (JP); Uhei Tamura, Ibaraki (JP); Shogo Nagura, Ibaraki (JP); Yoshinobu Saito, Ibaraki (JP)

(73) Assignee: P & PF Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/816,282

(22) PCT Filed: Feb. 25, 2011

(86) PCT No.: PCT/JP2011/054298

§ 371 (c)(1),
(2), (4) Date: Feb. 11, 2013

(87) PCT Pub. No.: WO2012/020579

PCT Pub. Date: Feb. 16, 2012

(65) Prior Publication Data

US 2013/0137624 A1 May 30, 2013

(30) Foreign Application Priority Data

Aug. 12, 2010 (JP) ..... 2010-180800

(51) Int. Cl.

| | |
|---|---|
| ***C11D 17/02*** | (2006.01) |
| ***C11D 9/04*** | (2006.01) |
| ***C11D 13/16*** | (2006.01) |

(52) U.S. Cl.
CPC *C11D 17/02* (2013.01); *C11D 9/04* (2013.01); *C11D 13/16* (2013.01)

(58) Field of Classification Search
None
See application file for complete search history.

(56) References Cited

U.S. PATENT DOCUMENTS

| | | | |
|---|---|---|---|
| 5,972,860 | A | 10/1999 | Eshita et al. |
| 2002/0132743 | A1 | 9/2002 | Nagahama |
| 2006/0276365 | A1 | 12/2006 | Mhatre et al. |

FOREIGN PATENT DOCUMENTS

| | | |
|---|---|---|
| CN | 1159427 | 7/2004 |
| EP | 0848056 | 6/1998 |
| JP | 59-27796 | 7/1984 |

(Continued)

OTHER PUBLICATIONS

European Search Report , EP 11816245.2, dated Jan. 17, 2014, 6 pages.

(Continued)

*Primary Examiner* — Necholus Ogden, Jr.
(74) *Attorney, Agent, or Firm* — Rankin, Hill & Clark LLP

(57) ABSTRACT

The present invention provides a framed soap containing uniformly entrained bubbles and a method for producing the same. The framed soap of the present invention is produced by cooling and solidifying high-temperature molten soap containing a fatty acid salt or an N-acyl acidic amino acid salt, prepared with the counter ion of which sodium is essential and an organic amine and potassium are optional, in a cylindrical cooling frame and characterized in that 10 volume % or higher air bubbles having a number average particle diameter of 65 μm or smaller are uniformly entrained.

12 Claims, 4 Drawing Sheets

(56) References Cited

FOREIGN PATENT DOCUMENTS

| | | |
|---|---|---|
| JP | 10-168494 | 6/1998 |
| JP | 11-43699 | 2/1999 |
| JP | 2005-2255 | 1/2005 |
| JP | 2006-45437 | 2/2006 |
| JP | 2006-176646 | 7/2006 |
| JP | 2009-144069 | 7/2009 |
| WO | 2004087856 | 10/2004 |

OTHER PUBLICATIONS

Translation of the International Preliminary Report on Patentability and Written Opinion, 8 pages.
International Search Report, International Application No. PCT/JP2011/054298, 4 pages.
English Summary of JP 59-27796, 1 page.
Patent Abstracts of Japan, Publication No. JP 2006-176646, 12 pages.
Patent Abstracts of Japan, Publication No. JP 2006-045437, 13 pages.
Patent Abstracts of Japan, Publication No. JP 2005-002255, 11 pages.
Patent Abstracts of Japan, Publication No. JP 11-043699, 10 pages.

FRAMED SOAP AND PROCESS FOR PRODUCING SAME

RELATED APPLICATIONS

This application claims the priority of Japanese Patent Application No. 2010-180800 filed on Aug. 12, 2010, which is incorporated herein by reference.

FIELD OF THE INVENTION

The present invention relates to a framed soap and a method for producing the same, and in particular, relates to a framed soap, wherein air bubbles are introduced into the framed soap by placing high-temperature molten soap in the frame, cooling, and solidifying, and a method for producing the same.

BACKGROUND OF THE INVENTION

In the past, the air bubble-containing soap, whose specific gravity is decreased by introducing air bubbles etc. so that it can float on water, has been publicly known.

On the other hand, the soap preparation methods are broadly classified into the framing method and the milling method.

The framed soap is prepared by pumping molten soap at a high temperature into a cylindrical cooling frame, cooling/solidifying the soap together with the cylindrical cooling frame, and then cutting and forming.

On the other hand, in the case of milled soap, soap chips that are formed beforehand are kneaded and plodded to shape a bar soap.

Among these common soap production methods, it has been very difficult to produce an air bubble-containing soap especially by the framing method.

That is, in the framing method, high-temperature/low-viscosity molten soap is pumped into a cylindrical cooling frame. Therefore, even when air bubbles are entrained in the molten soap, air bubbles float and separate inside the cylindrical frame during the cooling process. By cutting and shaping after cooling, a soap containing a large amount of air bubbles and a soap containing a very small amount of air bubbles are generated. Thus, it is difficult to obtain an air bubble-containing soap of uniform quality.

Therefore, in order to produce an air bubble-containing soap, the milling method was used in the past (patent literature 1). Alternatively, air bubbles were entrained in molten soap by individual shaping (method in which molten soap is poured into a frame of one soap, patent literature 2 etc.). Thus, either of these production methods has been used.

Patent literature 1: Japanese publication of examined application No. S59-27796 Patent literature 2: Japanese unexamined patent publication No. 2006-176646

DISCLOSURE OF THE INVENTION

Problem to be Solved by the Invention

The present invention was made in view of the above-described conventional art. An object of the invention is to provide a framed soap containing uniformly entrained bubbles and a method for producing the same.

Means to Solve the Problem

The present inventors have diligently studied to solve the above-described problems. As a result, the present inventors have found that a framed soap containing a large amount of uniformly entrained bubbles can be obtained through the production by cooling and solidifying high-temperature molten soap containing a fatty acid salt or an N-acyl acidic amino acid salt, prepared with the counter ion of which sodium is essential and an organic amine and potassium are optional, in a cylindrical cooling frame and by uniformly entraining 10 volume % or higher air bubbles having a number average particle diameter of 65 μm or smaller, thus leading to the completion of the present invention.

That is, the framed soap of the present invention is produced by cooling and solidifying high-temperature molten soap containing a fatty acid salt or an N-acyl acidic amino acid salt, prepared with the counter ion of which sodium is essential and an organic amine and potassium are optional, in a cylindrical cooling frame and characterized in that 10 volume % or higher and especially preferably 20 volume % or higher air bubbles having a number average particle diameter of 65 μm or smaller are uniformly entrained.

In addition, it is preferable that the fatty acid soap part is 25 to 40 mass % of the composition in the above-described framed soap, and isostearic acid is 2 to 10 mass % and stearic acid is 10 to 25 mass % in the fatty acid composition.

In addition, in the above-described framed soap, it is preferable that sodium:(organic amine+potassium) of the counter ion is 10:0 to 7:3 in the mole ratio.

In addition, in the above-described framed soap, it is preferable to contain 35 to 55 mass % of moisturizing agent part comprising a polyhydric alcohol, a glycerin compound, a sugar, and a sugar alcohol; and 15 to 25 mass % of water.

In addition, in the above-described framed soap, it is preferable that the solidification point of the high-temperature molten soap is 45 to 60° C.

In addition, in the above-described framed soap, it is preferable that the cylindrical cooling frame is a long cylindrical resin container wherein plural resin individual sections are connected through liquid channels.

In addition, in the above-described framed soap, it is preferable that the framed soap is a small soap of 50 g or less.

In addition, the production method of the framed soap of the present invention is characterized in that when high-temperature molten soap with entrained air bubbles is pumped into a cylindrical cooling frame, the molten soap is pumped into the cooling frame while fine and homogeneous air bubbles are being formed with a mill arranged in the vicinity of the pumping pipe spout.

In addition, in the above-described method, it is preferable that the mill is equipped with a cylindrical stator of about the same diameter as the pipe and a rotor that has a gap of 0.4 mm or less to the stator, rotates around the same axis as the flow channel, and has blades on its outer periphery.

In addition, in the above-described method, it is preferable that the diameter of the cylindrical stator is 100 to 200 mm and the rotor speed is 2000 to 4000 rpm.

Effect of the Invention

According to the framed soap of the present invention, because 10 volume % or higher air bubbles having a number average particle diameter of 65 μm or smaller are uniformly entrained, the specific gravity is low and it can be low-cost.

According to the production method of the framed soap of the present invention, by the adoption of a pipeline mill, the soap with an air bubble diameter of 65 μm or less and especially preferably 50 μm or less can be obtained, and no problem is generated in the distribution of air bubbles inside the cooling frame.

BEST MODE FOR CARRYING OUT THE INVENTION

Figure 1:
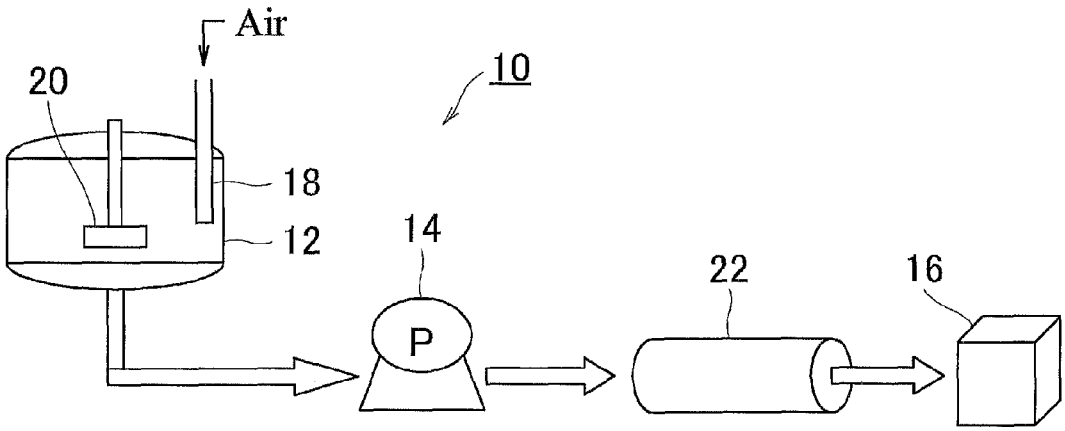
FIG. 1 is an illustration of the production process of the framed soap of the present invention.

The framed soap of the present invention is produced by cooling and solidifying high-temperature molten soap containing a fatty acid salt or an N-acyl acidic amino acid salt, prepared with the counter ion of which sodium is essential and an organic amine and potassium are optional, in a cylindrical cooling frame and characterized in that 10 volume % or higher air bubbles having a number average particle diameter of 65 μm or smaller are uniformly entrained. This soap is characterized in that the solubility and foaming property are good and the soap does not swell easily.

In the following, the composition of the present invention is described in detail.

The framed soap of the present invention is produced by pumping molten soap into a cylindrical cooling frame, cooling, and solidifying. It is especially preferable to apply it to a small soap of 50 g or less.

[Soap Part]

As soap part of the present invention, a fatty acid soap or an N-acyl acidic amino acid soap is preferable.

The fatty acids of fatty acid salts are saturated or unsaturated fatty acids having preferably 8 to 20 and more preferably 12 to 18 carbon atoms, and they may be either linear or branched. The specific examples include lauric acid, myristic acid, palmitic acid, stearic acid, oleic acid, isostearic acid, ricinoleic acid, linoleic acid, linolenic acid, 12-hydroxy stearic acid, and their mixture such as tallowate, coconut oil fatty acid, palm oil fatty acid, and palm kernel oil fatty acid.

In the present invention, it is preferable that 2 to 10 parts by mass of isostearic acid soap and 10 to 25 parts by mass of stearic acid soap are in 100 parts by mass of fatty acid soap part. In these ranges, fractures and cracks can be prevented when the soap material bar is removed from the cooling frame; in addition, the stickiness can be effectively suppressed.

Examples of N-acyl acidic amino acid salts include N-acylglutamic acid salts and N-acylaspartic acid salts.

In addition, in the framed soap of the present invention, sodium is essential as the counter ion, and potassium and/or organic amine can be adopted as other counter ions.

Here, as preferable specific examples of the organic amines, diethanolamine, triethanolamine, triethylamine, trimethylamine, diethylamine, etc. can be listed. Among them, triethanolamine is especially preferable. The organic amine can be used either alone or in combination of two or more.

As the counter ion, the ratio of sodium and potassium and/or organic amine, namely, sodium:(organic amine+potassium) is preferably 10:0 to 7:3 in the mole ratio. It is more preferably 9:1 to 7:3 and especially preferably 9:1 to 8:2.

The framed soap of the present invention can be produced according to a normal production method for solid soap. For example, fatty acid or animal/vegetable oil is saponified with an alkali, other components are mixed into as necessary, and the framed soap can be produced by the framing method in which the mixture is melted by heating, poured into a mold, and solidified by cooling.

The content of fatty acid salts in the framed soap of the present invention is preferably 25 to 40 mass % and especially preferably 30 to 37 mass % in the case of a small soap with a product weight of 50 g or less. If this content is less than 25 mass %, the solidification point becomes low and the surface will melt in the long-term storage; thus the commercial value may be reduced. On the other hand, if the content exceeds 40 mass %, the solubility by rubbing decreases and the usability as a small soap tends to be reduced.

[Moisturizing Agent Part]

As preferable saccharide or moisturizing agent used in the present invention, multitol, sorbitol, glycerin, 1,3-butylene glycol, propylene glycol, polyethylene glycol, sugar, pyrrolidone carboxylate, sodium pyrrolidone carboxylate, hyaluronic acid, polyoxyethlene alkyl glucoside ether, etc. can be listed. It is preferable to blend 35 to 55 mass % of saccharide and moisturizing agent in the composition.

Among them, it is preferable to blend 5 to 20 mass % of PEG1500 in the moisturizing agent part. By blending PEG1500, the high solubility by rubbing, which is specifically demanded for a small soap, is improved.

In addition, it is preferable to blend 0.001 to 0.01 mass % of PEG-90M (highly-polymerized polyethylene glycol) in the composition to improve the brittleness, which is observed in the air bubble-containing soap.

[Hydroxyalkyl Ether Carboxylic Acid Salt-Type Surfactant]

In the framed soap of the present invention, the addition of a hydroxyalkyl ether carboxylic acid salt-type surfactant is preferable, and the improvement in the foaming property is observed.

In the present invention, as the preferable hydroxyalkyl ether carboxylic acid salt-type surfactant, the surfactant represented by the below-described chemical formula (A) can be listed.

[Formula 1]

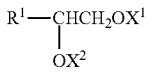

(A)

(In the formula, $R^1$ represents a saturated or unsaturated hydrocarbon group having 4 to 34 carbon atoms; any one of $X^1$ and $X^2$ represents —$CH_2COOM^1$, and the other represents a hydrogen atom; and $M^1$ represents a hydrogen atom, an alkali metal, an alkaline earth metal, an ammonium ion, a lower alkanolamine cation, a lower alkylamine cation, or a basic amino acid cation.)

In the formula, $R^1$ may be either an aromatic hydrocarbon or a linear or branched aliphatic hydrocarbon; however, an aliphatic hydrocarbon, especially an alkyl group or an alkenyl group is preferable. The preferable examples of $R^1$s include butyl group, octyl group, decyl group, dodecyl group, tetradecyl group, hexadecyl group, octadecyl group, docosyl group, 2-ethylhexyl group, 2-hexyldecyl group, 2-octylundecyl group, 2-decyltetradecyl group, 2-undecylhexadecyl group, decenyl group, dodecenyl group, tetradecenyl group, and hexadecenyl group. Among them, decyl group and dodecyl group are excellent in surfactant potency.

In addition, in the formula, any one of $X^1$ and $X^2$ represents —$CH_2COOM^1$, and the examples of $M^1$s include a hydrogen atom, a lithium, a potassium, a sodium, a calcium, a magnesium, an ammonium ion, a monoethanolamine, a diethanolamine, and a triethanolamine.

Specifically, among the above-described (A) hydroxyalkyl ether carboxylic acid salt-type surfactants, dodecane-1,2-diol acetic acid ether sodium salt, wherein H of either of the OH groups of dodecane-1,2-diol is substituted with —$CH_2COONa$, is most preferable.

In the present invention, the blending quantity of the hydroxyalkyl ether carboxylic acid salt-type surfactant is preferably 0.5 to 15 mass % and especially preferably 0.7 to 10 mass % in terms of the improvement in the foaming property.

[Chelator]

It is preferable that a chelator is added to the framed soap of the present invention.

In addition, the examples of preferable chelators used in the present invention include hydroxyethanedisulfonic acid and its salt. It is more preferable that the chelator is hydroxyethanedisulfonic acid. The blending quantity is preferably 0.001 to 1.0 mass % and more preferably 0.1 to 0.5 mass %. If the blending quantity of hydroxyethanedisulfonic acid and its salt is less than 0.001 mass %, the chelating effect is not satisfactory, and inconvenience such as yellowing over time may be caused. If the blending quantity is more than 1.0 mass %, the irritation to the skin becomes strong and it is not desirable.

In the framed soap of the present invention, the following components can be blended so far as the above-described effect is not undermined. The examples of such optional components include fungicides such as trichlorocarbanilide and hinokitiol; oils; perfumes; pigments; chelators such as edetate trisodium dihydrate; UV absorbers; antioxidants; natural extracts such as dipotassium glycyrrhizinate, psyllium extract, lecithin, saponin, aloe, phellodendron bark, and chamomile; nonionic, cationic or anionic water-soluble polymer; usability improving agents such as lactic acid ester; and foaming property improving agents such as sodium alkyl ether carboxylate, disodium alkyl sulfosuccinate, sodium alkyl isethionate, sodium polyoxyethylene alkyl sulfate, acyl methyl taurine, and sodium acyl sarcosinate.

The production method of the framed soap of the present invention is characterized in that when high-temperature molten soap with entrained air bubbles are pumped into a cylindrical cooling frame, the molten soap is pumped into the cooling frame while fine and homogeneous air bubbles are being formed with a mill that is arranged in the vicinity of the pumping pipe spout.

In addition, the fine air bubbles of the molten soap are made to be preferably 40 μm or smaller and especially preferably 36 μm or smaller with the mill.

In addition, it is preferable that the molten soap is adjusted to 60 to 65° C. when the soap is pumped into the cooling frame.

In addition, it is preferable that the mill is equipped with a cylindrical stator of about the same diameter as the pipe and a rotor that has a gap of 0.4 mm or less to the stator, rotates around the same axis as the flow channel, and has blades on its outer periphery.

The diameter of the cylindrical stator is preferably 100 to 200 mm. The rotor speed is preferably 2000 to 4000 rpm and especially preferably 3000 to 4000 rpm.

As the mill used in the production method of the framed soap of the present invention, a commercial pipeline mill (manufactured by PRIMIX Corporation), a micro/nano-bubble generator with the use of gas-liquid mixing shear method (manufactured by Kyowa Kisetsu Seisakusho K.K.), a thin-film spin system high-speed mixer (manufactured by PRIMIX Corporation), etc. can be used. Among them, it is especially preferable to use a pipeline mill.

EXAMPLES

The present invention will be further described in the following examples. However, the invention is not limited by these examples.

Prior to illustrating the examples, the methods for the evaluation tests used in the present invention will be explained.

Evaluation (1): Fracture Resistance

The fracture resistance test was carried out for the sample bar soap (material bar). That is, after solidification, the state of the material bar at the time of removal from the cylindrical cooling frame was evaluated by the following evaluation criteria.

A: The fracture resistance of the material bar was good.

B: Cracks were generated on the material bar.

C: The material bar was fractured.

Evaluation (2): Stickiness 10 professional panelists evaluated the stickiness when each sample was used.

A: 8 or more panelists answered that the stickiness was not present.

B: 5 or more and less than 8 panelists answered that the stickiness was not present.

C: Less than 5 panelists answered that the stickiness was not present.

Evaluation (3): Hardness 10 professional panelists evaluated the hardness of the sample.

A: 8 or more panelists answered that the sample was hard.

B: 5 or more and less than 8 panelists answered that the sample was hard.

C: Less than 5 panelists answered that the sample was hard.

Evaluation (4): Viscosity Increase During Reaction

The viscosity increase of the molten soap during sample stirring was evaluated by the following evaluation criteria.

A: There was free of untoward effects on production due to the viscosity increase during reaction.

C: The viscosity increased too much during reaction and the stirring was difficult.

Evaluation (5): Appearance

The appearance of the shaped sample was evaluated based on the below-described evaluation criteria.

A: The appearance was smooth and good.

C: The appearance was rough and not good.

Evaluation (6): Bubble Entrainment

The bubble entrainment of the shaped sample was evaluated based on the below-described evaluation criteria.

A: The bubble entrainment in the sample was good (the content of air bubbles was 20% or higher).

B: The bubble entrainment in the sample was somewhat good (the content of air bubbles was 10% or higher and lower than 20%).

C: The bubble entrainment in the sample was not good (the content of air bubbles was lower than 10%).

Evaluation (7): Bubble Distribution Uniformity

The bubble distribution uniformity of the shaped sample was evaluated based on the below-described evaluation criteria.

A: Air bubble distribution in the sample was uniform.

B: Air bubble distribution in the sample was somewhat uniform.

C: Air bubble distribution in the sample was not uniform.

At first, the present inventors tried the production of air bubble-containing soap by using the basic formulation comprising the below-described soap part, moisturizing agent part, and the others. The method to entrain air bubbles is described in the below-described production method. After the entrainment of air bubbles, the molten soap was placed in various apparatuses shown in Table 1 and then cooled/solidified. The values in the parentheses in the sections of the apparatus pipeline mill in Table 1 are the gaps between the grinding section and the opposing section.

Basic Formulation

| | |
|---|---|
| Soap part | 35.0% |
| Lauric acid | 20 parts |
| Myristic acid | 55 parts |
| Stearic acid | 20 parts |
| Isostearic acid | 5 parts |

Neutralized with sodium hydroxide:triethanolamine = 8:2 (mole ratio)

| | |
|---|---|
| Moisturizing agent part | 40.0% |
| Concrete glycerin | 25 parts |
| 1,3-butylene glycol | 15 parts |
| POE(7 mol) glyceryl | 10 parts |
| Polyethylene glycol 1500 | 13 parts |
| Sorbitol | 6.5 parts |
| Sucrose | 30.5 parts |

| | |
|---|---|
| The others | 25.0% |
| Dodecane-1,2-diol acetic acid ether sodium salt | 10.0 parts |
| PEG-90M | 0.005 parts |
| Chelator | 0.1 parts |
| Titanium oxide | 0.2 parts |
| Sodium hexametaphosphate | 0.2 parts |
| Ion exchanged water | 16.495 parts |

Production Method

Production equipment 10 of air bubble-containing framed soap of the present invention is shown in the FIG. 1.

The production equipment 10 is equipped with a melting pot 12, in which the above-described basic formulation components are heated and melted, a pump 14 with which the molten soap is transferred from the melting pot 12, and a cooling container 16 having plural bottomed cylindrical cooling frames. The molten soap that is pumped out from the melting pot 12 with the pump 14 is poured into the cooling frames of the cooling container 16. After cooling and solidification, the bar soap (material bar) is removed from the cooling frame, then cut and shaped.

In the present invention, in order to produce air bubble-containing soap, an air injection pipe 18 is placed inside the melting pot 12. While the bubbling is being carried out, the stirring is performed with a stirring blade 20.

The uniqueness of the present invention is that a means for entraining fine bubbles is provided when the molten soap is pumped into the cooling container 16. In the following tests of the present invention, a pipeline mill was used as the means for entraining fine bubbles.

Figure 2:
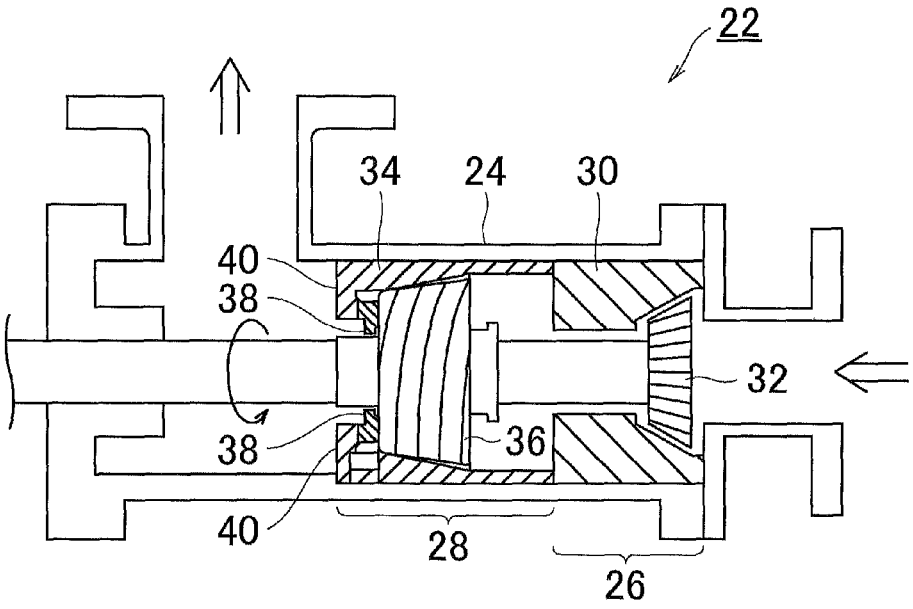
FIG. 2 is an illustration of the main section of a pipeline mill, which is characteristic of the present invention.

In the present embodiment, the pipeline mill is equipped with a cylindrical stator of about the same diameter (100 to 200 mm) as the pipe and a rotor that has a gap of 0.4 mm or less to the stator, rotates around the same axis as the flow channel, and has blades on its outer periphery. That is, the pipeline mill 22 is equipped with a first crushing section 26 and a second crushing section 28, as shown in the cross-sectional drawing in FIG. 2, in an L-shaped cylindrical housing 24 with an opening size of about 100 mm. The first crushing section is equipped with a first mortar-shaped cylindrical stator 30 and a first flat-head conical rotor 32, which is tailored to the mortar shape of the first stator 30, and applies a stirring/shearing force to the molten soap that flows in from the right side in the figure. The second crushing section 28 is similarly equipped with a second mortar-shaped cylindrical stator 34, a second flat-head conical rotor 36, which is tailored to the mortar shape of the second stator 34, and a grinding section 38, which is installed at the top section of the second rotor 36. The gap between the grinding section 38 and the opposing section 40 of the second rotor 36 is adjustable. In addition, concaves and convexes are formed on each of the grinding section 38 and the opposing section 40, the gap between them is adjustable within the range of 0.1 to 5 mm, and the rotor speed is 2000 to 4000 rpm.

In the below-described test examples, the rotor speed was adjusted to 3500 rpm. Unless otherwise specified, the gap between the grinding section and the opposing section of the pipeline mill was adjusted to 0.2 mm.

Figure 3:
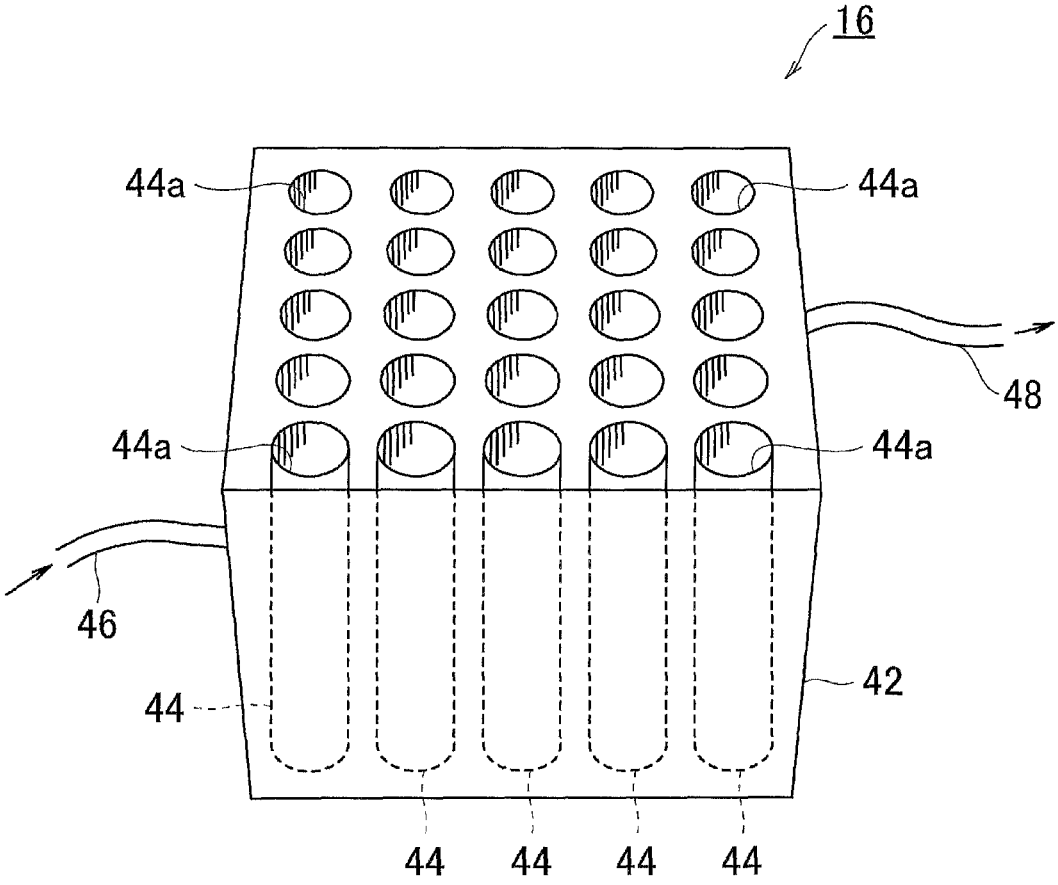
FIG. 3 is an illustration of the common cooling container used in the present invention.

In the present embodiment, as the cooling container 16, 25 cylindrical cooling frames 44 are arranged inside a cubic main body 42 as shown in FIG. 3, and openings 44*a* of the respective cooling frames 44 are formed on the top surface of the main body 42. To the main body 42, cooling water is introduced through a cooling water introduction route 46 and discharged through a discharge route 48.

The cooling frame 44 used in the present test was of a diameter of 50 mm and a length (height) of 1000 mm. The molten soap at the time of pumping into the cooling frame was 60 to 65° C. Immediately after pumping into the cooling container 16, the cooling was carried out with cooling water at 20° C.

TABLE 1

| | Test Example | | | | |
|---|---|---|---|---|---|
| | 1-1 | 1-2 | 1-3 | 1-4 | 1-5 |
| Apparatus | None | pipeline homomixer (X1) | pipeline mill (0.5 mm) | pipeline mill (0.2 mm) | pipeline mill (0.1 mm) |
| Air bubble diameter of molten soap in the pot (μm) | 40 | 40 | 40 | 40 | 40 |
| Air bubble diameter of discharge molten soap (μm) | 40 | 30 | 30 | 20 | 15 |
| Appearance of material bar | rough | rough | slightly rough | smooth | smooth |
| Air bubble content after solidification (%) | 25 | 25 | 25 | 25 | 25 |

TABLE 1-continued

| | Test Example | | | | |
|---|---|---|---|---|---|
| | 1-1 | 1-2 | 1-3 | 1-4 | 1-5 |
| Specific gravity of top of frame | 0.751 | 0.79 | 0.805 | 0.843 | 0.849 |
| Specific gravity of middle of frame | 0.799 | 0.835 | 0.84 | 0.853 | 0.857 |
| Specific gravity of bottom of frame | 0.992 | 0.958 | 0.891 | 0.891 | 0.862 |

(※1): A stirring blade is contained inside the cylindrical stator.

As is clear from Table 1, the production of the framed soap containing air bubbles has become possible with the use of a pipeline mill. In particular, if the bubble diameter is made to be 30 μm or smaller with the mill, the appearance of the material bar becomes smooth. In addition, the weight distribution (distribution of air bubbles) in the cooling frame becomes extremely good. Thus, the use of a pipeline mill is very preferable to uniformly entrain air bubbles. It is practically unachievable by stirring with only the stirring blade inside the pot or that inside the pipe.

The present inventors have investigated stirring conditions only with the stirring blade in the melting pot 12. As shown in Table 2 below, the air bubble diameter of about 40 μm was the limit. When the molten soap of a very large air bubble diameter was poured into the cooling container, cracks and fractures were generated at the removal stage of the material bar.

TABLE 2

| | Test Example | | | |
|---|---|---|---|---|
| | 2-1 | 2-2 | 2-3 | 2-4 |
| Stirring time (minutes) | 0 | 10 | 30 | 80 |
| Air bubble diameter of molten soap in the pot (μm) | 0 | 110 | 85 | 40 |
| Air bubble content in the pot (%) | 0 | 14.2 | 25.5 | 34.3 |
| Apparatus | none | None | none | none |
| Appearance of material bar | — | fracture generation | fracture generation in rare cases | fracture generation in rare cases |
| Air bubble content after solidification (%) | 0 | 11.9 | 19 | 25.2 |
| Specific gravity of top of frame | 1.139 | 0.923 | 0.863 | 0.903 |
| Specific gravity of middle of frame | 1.138 | 1.003 | 0.923 | 0.855 |
| Specific gravity of bottom of frame | 1.143 | 1.06 | 0.997 | 0.925 |

As described above, in the production of air bubble-containing soap by the framing method, air bubbles cannot be made to be sufficiently small by the stirring with the stirring blade in the melting pot or that in the pipeline. As a result, defects such as fractures and cracks are generated in the material bar; in addition, the distribution of air bubbles inside the frame becomes non-uniform.

According to the results of further investigation by the present inventors, after air bubbles are entrained in the melting pot, framed soap that is uniform and troubleless in the removal of the material bar can be produced by applying a pipeline mill immediately before pumping into the cooling container and allowing the air bubble diameter to be preferably 40 μm or smaller and especially preferably 36 μm or smaller.

Because high-temperature molten soap contracts during cooling, air bubbles after solidification become relatively large. This enlargement of air bubbles was 5 to 25 μm according to the results of the investigation by the present inventors. Considering this, the air bubble of the soap after solidification has a number average particle diameter of preferably 65 μm or smaller and especially preferably 50 μm or smaller.

Figure 4:
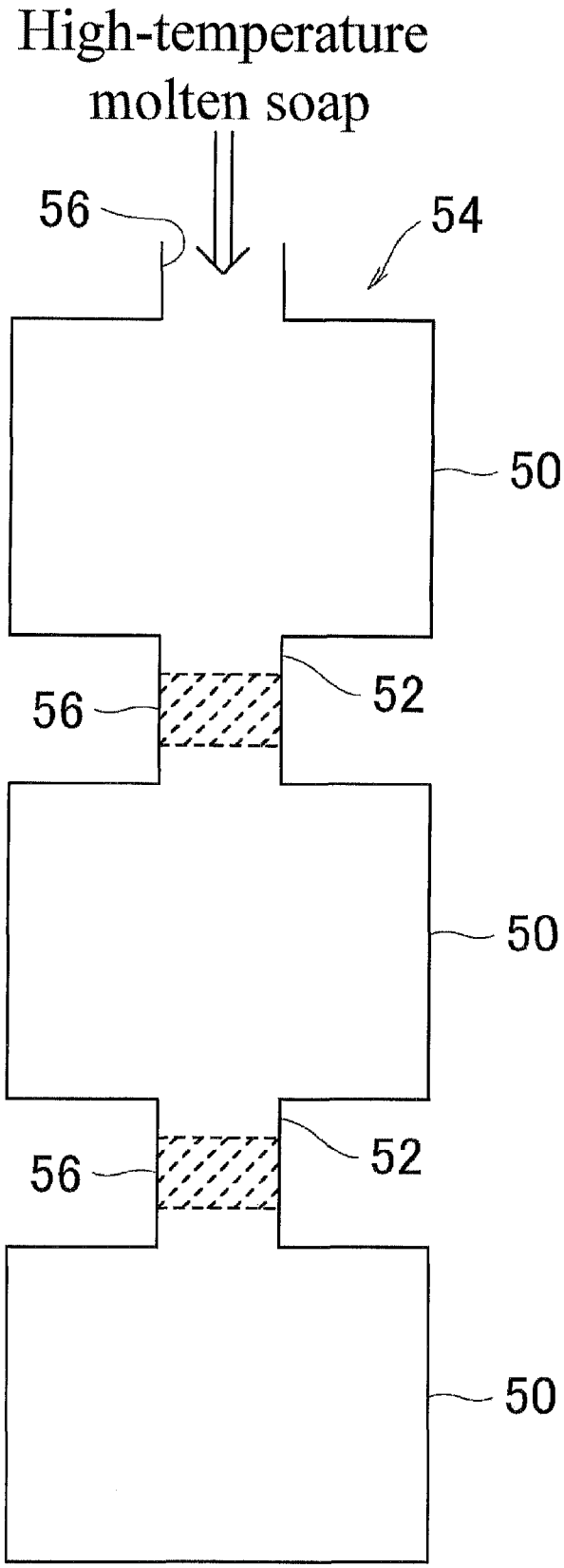
FIG. 4 is another example of the cooling frame (long cylindrical resin container) used in the present invention.

In the present invention, in addition to normal cylindrical cooling frames, a long cylindrical resin container wherein plural individual resin sections are connected through liquid channels can be used as the cooling container. For example, as shown in FIG. 4, a resin container 54 having wide parts 50 and narrow passages 52 can be used. After pumping high-temperature molten soap from the opening on the top, the narrow passage section 52 is joined/sealed (56 in the figure) and individually packaged framed soaps can be prepared.

In addition to the merit that the specific gravity is reduced because of the presence of air bubbles, the framed soap of the present invention can be suitably used, for example, as a small single-use disposal soap that is provided at accommodation facilities.

That is, at accommodation facilities, a small single-use disposal soap may be provided to each lodging guest from the standpoint of health. Naturally, when the lodging period is short, the use of soap is very little; however, the usability becomes poor if the soap is too small.

Thus, the usage of soap can be reduced, while the size suitable for use is maintained, by decreasing the soap components with respect to the volume as in the present invention.

When air bubbles are entrained in such a small soap, it is necessary to prevent not only cracks and fractures of a material bar but also fractures of soap itself.

In addition, in the normal soap composition, satisfactory dissolution of cleansing components cannot be expected during use because of a small surface area due to a small size of the soap. Therefore, in such a small soap, it is necessary that the soap is soft and easily soluble during use. Thus, the present inventors also investigated easily soluble soap compositions for a small soap.

At first, the present inventors investigated the composition, for a small soap, from the viewpoint of easy dissolution during use. That is, each soap was produced by changing only the composition of the counter ion in the above-described basic formulation. Then, each obtained soap was evaluated in the above-described methods for the evaluation tests.

The results are shown in Table 3 and Table 4.

TABLE 3

| | Test Example | | | | |
|---|---|---|---|---|---|
| | 3-1 | 3-2 | 3-3 | 3-4 | 3-5 |
| Na:K:TEA | 10:0:0 | 9:0:1 | 8:0:2 | 7:0:3 | 6:0:4 |
| Air bubble content after solidification (%) | 12 | 25 | 25 | 25 | 25 |
| Solidification point (° C.) | | 52.7 | 47.7 | | |
| Fracture resistance | A | A | A | A | A |
| Stickiness | A | A | A | A | A |
| Hardness | A | A | A | B | C |

TABLE 4

| | Test Example | | | | |
|---|---|---|---|---|---|
| | 3-6 | 3-7 | 3-8 | 3-9 | 3-10 |
| Na:K:TEA | 9:1:0 | 8:1:1 | 7:2:1 | 7:1:2 | 6:1:3 |
| Air bubble content after solidification (%) | 15 | 25 | 25 | 25 | 25 |
| Solidification point (° C.) | | 55.4 | 50.6 | 45.7 | 36.9 |
| Fracture resistance | A | A | A | A | A |
| Stickiness | A | A | B | A | A |
| Hardness | A | A | A | B | C |

From the results of the above Table 3 and Table 4, when Na was 100%, the viscosity of molten soap increased, and the entrainment of air bubbles was somewhat difficult. On the other hand, when K and TEA exceeded 30%, especially the hardness of soap decreased and the product adequacy decreased. Accordingly, Na:(TEA+K) is preferably 10:0 to 7:3 and especially preferably 9:1 to 7:3 in the mole ratio.

Next, the present inventors investigated the fatty acid composition. That is, each soap was produced by changing only the composition of the soap part in the above-described basic formulation. Then, each obtained soap was evaluated in the above-described methods for the evaluation tests.

The results are shown in the Table 5 and Table 6.

TABLE 5

| | Test Example | | | | |
|---|---|---|---|---|---|
| | 5-1 | 5-2 | 5-3 | 5-4 | 5-5 |
| Lauric acid | 35 | 27 | 20 | 20 | 15 |
| Myristic acid | 65 | 53 | 50 | 55 | 50 |
| Stearic acid | — | 10 | 20 | 20 | 30 |
| Isostearic acid | — | 10 | 10 | 5 | 5 |
| Counterion | equivalent | equivalent | equivalent | equivalent | equivalent |
| Viscosity increase during reaction | A | A | A | A | B |
| Air bubble content after solidification (%) | 25 | 25 | 25 | 25 | 25 |
| Hardness | B | A | A | A | A |
| Fracture resistance | B | A | A | A | A |
| Stickiness | A | A | B | A | A |

TABLE 6

| | Test Example | | | | | |
|---|---|---|---|---|---|---|
| | 5-6 | 5-7 | 5-8 | 5-9 | 5-10 | 5-11 |
| Lauric acid | 30 | 20 | 20 | 27 | 25 | 27 |
| Myristic acid | 55 | 55 | 45 | 55 | 50 | 45 |
| Stearic acid | 10 | 20 | 30 | 15 | 22 | 25 |
| Isostearic acid | 5 | 5 | 5 | 3 | 3 | 3 |
| Counterion | equivalent | equivalent | equivalent | equivalent | equivalent | equivalent |
| Viscosity increase during reaction | A | A | B | A | A | A |
| Air bubble content after solidification (%) | 25 | 25 | 25 | 25 | 25 | 25 |
| Hardness | A | A | A | A | A | A |

TABLE 6-continued

| | Test Example | | | | | |
|---|---|---|---|---|---|---|
| | 5-6 | 5-7 | 5-8 | 5-9 | 5-10 | 5-11 |
| Fracture resistance | A | A | A | A | A | A |
| Stickiness | A | A | A | A | A | A |

As is clear from Table 5 and Table 6, the fracture resistance of the material bar is improved by blending stearic acid and isostearic acid; however, by blending them excessively, stickiness tends to be generated or thickening tends to take place during reaction.

As a result of further detailed investigation, it was clarified that by blending 2 to 10 mass % of isostearic acid and 10 to 25 mass % of stearic acid in the fatty acid composition, the fracture resistance could be improved while the stickiness is suppressed.

In addition, the present inventors have carried out the investigation, by assuming the use for a small soap, of the moisturizing agent part to improve the during-use solubility. That is, each soap was produced by changing only the composition of the moisturizing agent part in the above-described basic formulation. Then, each obtained soap was evaluated in the above-described methods for the evaluation test.

The results are shown in the Table 7.

TABLE 7

| | Test Example | | | | |
|---|---|---|---|---|---|
| | 7-1 | 7-2 | 7-3 | 7-4 | 7-5 |
| 1,3-butylene glycol | 15 | 15 | 15 | 15 | 15 |
| POE(7 mol) glyceryl | 10 | 10 | 10 | 10 | 10 |
| Glycerin | 31 | 25 | 25 | 19 | 25 |
| Sucrose | 37 | 32 | 32 | 37 | 32 |
| Sorbitol | 7 | 6 | 6 | 7 | 6 |
| PEG1500 | — | — | 12 | — | 12 |
| PEG4000 | — | 12 | — | 12 | — |
| PEG-90M | — | — | — | — | 0.005%/all quantity |
| Hardness | 430 | 530 | 500 | 560 | 330 |
| Solubility by rubbing | 72 | 74 | 78 | 73 | 81 |
| Stickiness | B | A | A | B | A |
| Appearance | A | C | A | C | A |

From Table 7, it is seen to be preferable to use PEG1500 in order to improve the usability of a small soap by increasing the solubility by rubbing and improving the formativeness. As a result of further detained investigation, it was clarified that the blending quantity was 5 to 20 mass % in the moisturizing agent part.

In addition, by blending 0.005 mass % of PEG-90M in the composition, the hardness was reduced, but the brittleness was improved.

Next, the present inventors investigated the effect of salt use (improvement in solidification). That is, the effect was investigated by adding 1.0 mass % of sodium chloride into the system in which the amphoteric surfactant (dodecane-1,2-diol acetate ether sodium salt) used for foaming improvement was removed from the basic formulation.

TABLE 8

| | Test Example | |
|---|---|---|
| | 8-1 | 8-2 |
| Soap part | 37% | 37% |
| Lauric acid | 20 | |
| Myristic acid | 55 | |

TABLE 8-continued

| | Test Example | |
|---|---|---|
| | 8-1 | 8-2 |
| Stearic acid | 20 | |
| Isostearic acid | 5 | |
| Na:K:TEA | 8:0:2 | |
| Moisturizing agent part | 40% | 40% |
| Concrete glycerin | 25 | |
| 1,3-butylene glycol | 15 | |
| POE(7 mol) glyceryl | 10 | |
| PEG1500 | 13 | |
| Sorbitol | 6.5 | |
| Sucrose | 30.5 | |
| The others | 23% | 22% |
| PEG-90M | 0.005 | |
| Chelator | 0.1 | |
| Titanium oxide | 0.2 | |
| Sodium hexametaphosphate | 0.2 | |
| Ion exchanged water | 16.495 | |
| NaCl | — | 1% |
| Solidification point (° C.) | 49.7 | 51.5 |
| Hardness | A | A |
| Stickiness | A | A |

From Table 8, it is seen that the addition of salt is effective to maintain bubble uniformity because of an increase in the solidification point and early solidification in the cooling frame.

Subsequently, the present inventors investigated the solidification point of molten soap and the properties. Thus, the present inventors have found, during the course of various investigations, that there is a close relationship among various properties including the solidification point, air bubble entrainment, and product hardness. The investigation results are shown in Tables 9-1 to 9-3.

TABLE 9-1

| | Test Example | | |
|---|---|---|---|
| | 9-1 | 9-2 | 9-3 |
| Soap part | 36.5% | 37% | 36.5% |
| Lauric acid | 8.1 | 8.1 | 8.1 |
| Myristic acid | 16.4 | 17 | 16.5 |
| Stearic acid | 3.4 | 3.5 | 3.4 |
| Isostearic acid | 1.5 | 1.5 | 1.5 |
| Na:K:TEA | 6:3:1 | 7:1:2 | 7:0:3 |
| Moisturizing agent part | 41.6% | 41.6% | 40.6% |
| Concrete glycerin | 8 | 8 | 8 |
| 1,3-butylene glycol | 11.8 | 11.8 | 11.8 |
| POE(7 mol) glyceryl | 3 | 3 | 3 |
| PEG1500 | 4 | 4 | 4 |
| Sorbitol | 2.5 | 2.5 | 2.5 |
| Sucrose | 12.3 | 12.3 | 12.3 |
| Water | balance | balance | balance |
| NaCl | — | — | 1% |
| Solidification point (° C.) | 36.9 | 45.7 | 46 |
| Hardness | C | B | A |
| Stickiness | B | A | A |
| Bubble entrainment | A | A | A |
| Bubble distribution uniformity | C | B | A |

TABLE 9-2

| | Test Example | | |
|---|---|---|---|
| | 9-4 | 9-5 | 9-6 |
| Soap part | 36.5% | 36.5% | 36.5% |
| Lauric acid | 8.4 | 8.4 | 6.8 |
| Myristic acid | 17 | 17 | 17.8 |

TABLE 9-2-continued

| | Test Example | | |
|---|---|---|---|
| | 9-4 | 9-5 | 9-6 |
| Stearic acid | 3.5 | 3.5 | 3.7 |
| Isostearic acid | 1.5 | 1.5 | 1.6 |
| Na:K:TEA | 7:1:2 | 7:1:2 | 9:0:1 |
| Moisturizing agent part | 43.6% | 40.6% | 43.6% |
| Concrete glycerin | 8 | 8 | 8 |
| 1,3-butylene glycol | 11.8 | 10.8 | 11.8 |
| POE(7 mol) glyceryl | 3 | 3 | 5 |
| PEG1500 | 4 | 4 | 4 |
| Sorbitol | 2.8 | 2.5 | 2.5 |
| Sucrose | 14 | 12.3 | 12.3 |
| Water | balance | balance | balance |
| NaCl | — | 1% | — |
| Solidification point (° C.) | 49.7 | 51.5 | 55 |
| Hardness | A | A | A |
| Stickiness | A | A | A |
| Bubble entrainment | A | A | A |
| Bubble distribution uniformity | A | A | A |

TABLE 9-3

| | Test Example | | |
|---|---|---|---|
| | 9-7 | 9-8 | 9-9 |
| Soap part | 29% | 30% | 34% |
| Lauric acid | 6.2 | 6.4 | 8.6 |
| Myristic acid | 12.5 | 13 | 17.3 |
| Stearic acid | 5.1 | 5.3 | 1.9 |
| Isostearic acid | 2.7 | 2.7 | 3.1 |
| Na:K:TEA | 10:0:0 | 10:0:0 | 10:0:0 |
| Moisturizing agent part | 51.6% | 40.6% | 43.6% |
| Concrete glycerin | 8 | 8 | 8 |
| 1,3-butylene glycol | 11.8 | 11.8 | 11.8 |
| POE(7 mol) glyceryl | 5 | 8 | 5 |
| PEG1500 | 8 | 4 | 4 |
| Sorbitol | 3.2 | 3.2 | 2.9 |
| Sucrose | 15.6 | 15.6 | 13.9 |
| Water | balance | balance | balance |
| NaCl | — | — | — |
| Solidification point (° C.) | 55.8 | 58 | 61.2 |
| Hardness | A | A | A |
| Stickiness | A | A | A |
| Bubble entrainment | A | A | C |
| Bubble distribution uniformity | A | A | A |

As is clear from Tables 9-1 to 9-3, the solidification point, hardness, bubble entrainment, and bubble distribution uniformity are closely related. When the solidification point is low, the bubble entrainment is easy; however the product hardness and the bubble distribution uniformity tend to decrease. When the solidification point is high, the bubble distribution uniformity is good; however, the bubble entrainment tends to decrease.

Accordingly, the solidification point of the high-temperature molten soap of the present invention is preferably 45 to 60° C. and especially preferably 50 to 58° C.

DESCRIPTION OF THE NUMERALS

10: A production equipment of framed soap
12: A melting pot
14: A pump
16: A cooling container
18: An air injection pipe
20: A stirring blade
22: A pipeline mill
24: A L-shaped cylindrical housing
26: A first crushing section

28: A second crushing section
30: A first mortar-shaped cylindrical stator
32: A first flat-head conical rotor
34: A second mortar-shaped cylindrical stator
36: A second flat-head conical rotor
38: A grinding section
40: An opposing section
42: A cubic main body
44: A cylindrical cooling frame
44*a*: An opening
46: A cooling water introduction route
48: A discharge route
50: A wide part
52: A narrow passage
54: A resin container
56: A joined/sealed part

What is claimed is:

1. A framed soap produced by cooling and solidifying, in a cylindrical cooling frame, a high-temperature molten soap containing a fatty acid salt prepared with a counter ion comprising sodium and at least one selected from a group consisting of an organic amine and potassium, wherein 10 volume % or more of air bubbles having a number average particle diameter of 65 μm or smaller are uniformly entrained;

a fatty acid of the fatty acid salt is 25 to 40 mass % of the framed soap, and isostearic acid is 2 to 10 mass % and stearic acid is 10 to 25 mass % in the fatty acid; and a ratio of moles of sodium to total moles of organic amine and potassium of the counter ion is 9:1 to 7:3.

2. The framed soap according to claim 1, wherein the framed soap contains 35 to 55 mass % of a moisturizing agent part comprising a polyhydric alcohol, a glycerin compound, a sugar, and a sugar alcohol; and 15 to 25 mass % of water.

3. The framed soap according to claim 1, wherein the solidification point of the high-temperature molten soap is 45 to 60° C.

4. The framed soap according to claim 1, wherein the cylindrical cooling frame is a long cylindrical resin container wherein plural resin individual sections are connected through liquid channels.

5. The framed soap according to claim 1, wherein the framed soap is a small soap of 50 g or less.

6. A production method of the framed soap according to claim 1, comprising:

when a high-temperature molten soap having entrained air bubbles is pumped into a cylindrical cooling frame, the high-temperature molten soap containing a soap part comprising a fatty acid salt or an N-acyl acidic amino acid salt prepared with the counter ion of which sodium is essential and an organic amine and potassium are optional, breaking down and homogenizing the air bubbles by a mill arranged in the vicinity of a pumping pipe spout and pumping the molten soap into the cooling frame such that 10 volume % or more of air bubbles having a number average particle diameter of 65 μm or smaller are uniformly entrained in the framed soap.

7. The production method according to claim 6, wherein the mill is equipped with a cylindrical stator of about the same diameter as the pipe, and a rotor that has a gap of 0.4 mm or less to the stator, rotates around the same axis as the flow channel, and has blades on its outer periphery.

8. The production method according to claim 7, wherein the diameter of the cylindrical stator is 100 to 200 mm and the rotor speed is 2000 to 4000 rpm.

9. The framed soap according to claim 2, wherein the solidification point of the high-temperature molten soap is 45 to 60° C.

10. A production method of the framed soap according to claim 1, comprising:

when a high-temperature molten soap having entrained air bubbles is pumped into a cylindrical cooling frame, the high-temperature molten soap containing a soap part comprising a fatty acid salt or an N-acyl acidic amino acid salt prepared with the counter ion of which sodium is essential and an organic amine and potassium are optional, breaking down and homogenizing the air bubbles by a mill arranged in the vicinity of a pumping pipe spout and pumping the molten soap into the cooling frame such that 10 volume % or more of air bubbles having a number average particle diameter of 65 μm or smaller are uniformly entrained in the framed soap.

11. The production method according to claim 10, wherein the mill is equipped with a cylindrical stator of about the same diameter as the pipe, and a rotor that has a gap of 0.4 mm or less to the stator, rotates around the same axis as the flow channel, and has blades on its outer periphery.

12. The production method according to claim 11, wherein the diameter of the cylindrical stator is 100 to 200 mm and the rotor speed is 2000 to 4000 rpm.

* * * * *